US005267793A

United States Patent [19]

Hawitt

[11] Patent Number: 5,267,793

[45] Date of Patent: Dec. 7, 1993

[54] INK AGITATING APPARATUS HAVING A FLEXIBLE BLADE WHICH TWISTS DURING LATERAL RECIPROCATION

[75] Inventor: Peter R. Hawitt, Haydock, England

[73] Assignee: J & C Moores Ltd., Liverpool, England

[21] Appl. No.: 841,316

[22] Filed: Feb. 25, 1992

[30] Foreign Application Priority Data

Feb. 27, 1991 [GB] United Kingdom ..... 9104084

[51] Int. Cl.[5] ..... B01F 11/00; B41F 31/06

[52] U.S. Cl. ..... 366/332; 101/364; 101/DIG. 34

[58] Field of Search ..... 366/203, 255, 256, 332-336, 366/345; 101/363, 364, DIG. 34

[56] References Cited

U.S. PATENT DOCUMENTS

| | | | |
|---|---|---|---|
| 1,447,849 | 3/1923 | Hough | 101/DIG. 34 X |
| 1,778,600 | 10/1930 | Jones | 101/364 |
| 1,896,034 | 1/1933 | Weed | 101/DIG. 34 X |
| 2,447,868 | 8/1948 | Ortleb | 101/364 |
| 2,613,601 | 10/1952 | Forbes | 101/364 |
| 2,983,222 | 5/1961 | Bakalars | 101/DIG. 34 X |
| 3,173,363 | 3/1965 | Martin | 366/332 X |
| 4,461,210 | 7/1984 | MacPhee et al. | 101/364 X |
| 4,589,337 | 5/1986 | Hardin | 101/363 |

FOREIGN PATENT DOCUMENTS

| | | | |
|---|---|---|---|
| 3539828 | 5/1987 | Fed. Rep. of Germany | 101/364 |
| 253401 | 1/1988 | German Democratic Rep. | 101/363 |
| 245604 | 1/1926 | United Kingdom . | |

*Primary Examiner*—Harvey C. Hornsby
*Assistant Examiner*—Charles Cooley
*Attorney, Agent, or Firm*—Christie, Parker & Hale

[57] ABSTRACT

An ink agitating apparatus comprises a generally rectangular curved blade having concave recesses in its side and bottom edges. The blade is adapted to be reciprocated laterally by a pneumatic mechanism. The blade is flexible so that it can be twisted longitudinally by the hydrodynamic forces to which it is subjected when it moves through the ink to improve the agitation characteristic achieved by the blade.

6 Claims, 2 Drawing Sheets

FIG. 1
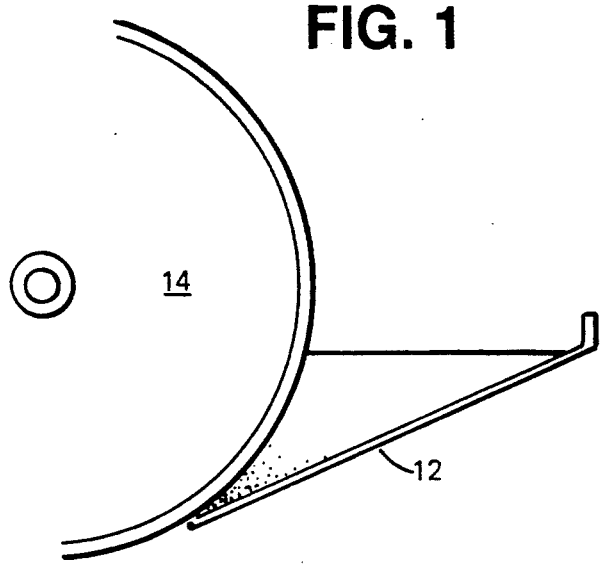
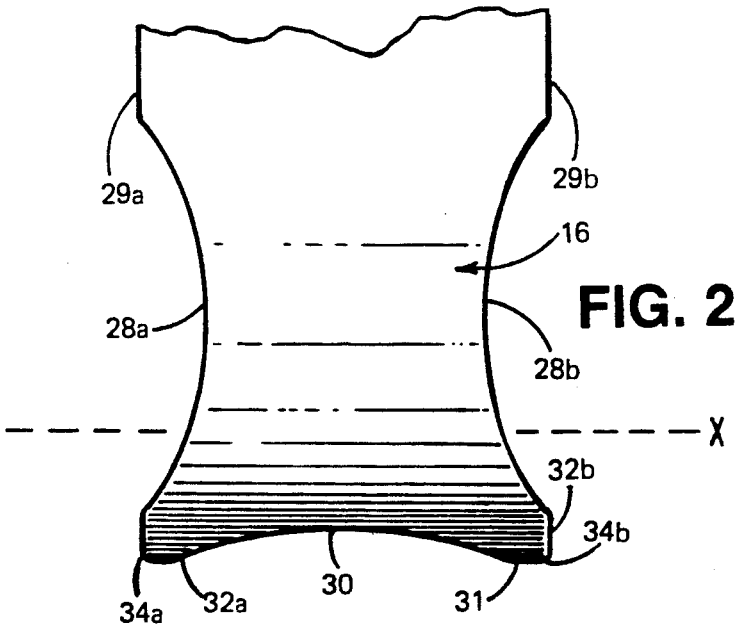
FIG. 2

INK AGITATING APPARATUS HAVING A FLEXIBLE BLADE WHICH TWISTS DURING LATERAL RECIPROCATION

The present invention relates to an ink agitating apparatus for use in paper printing machinery.

Conventional paper printing machinery usually incorporates a means for applying ink onto one or more inking rollers. In one form, the ink is disposed in an open sided tray adjacent to an inking roller. Reciprocating fingers within the ink pool in the tray establish the actual quantity of ink to be taken up by the roller. A problem that arises with this apparatus is the transmission of material, such as lint and dust, onto the inking roller via other rollers and eventually into the ink reservoir where it tends to collect in the bottom nip between the roller and the ink tray. This can subsequently cause clogging of the ink and nonuniformity in the inkthickness applied to the ink roller. Many apparatuses exist for agitating the ink in the ink pool to prevent the build-up of lint, dust and the like in the nip area. Several of the apparatuses use an ink agitating blade which is arranged to extend into the ink pool and which is reciprocated pneumatically along the length of the pool to agitate the ink. However, these devices are not very satisfactory as the ink usually becomes over-agitated, thus affecting the ink distribution on the inking roller and often causing ink spillage and splashing.

It is an object of the present invention to provide an ink agitating apparatus having an ink agitating blade possessing improved operational characteristics.

In accordance with a first aspect of the present invention, there is provided an ink agitating apparatus for agitating ink in an ink tray disposed adjacent to an inking roller in a printing machine, the ink agitating apparatus comprising a flexible, longitudinally curved blade which is adapted to be suspended into the ink in the ink tray and to be reciprocated laterally therewithin.

Preferably, the blade comprises a flexible sheet of plastic or metal having leading and trailing side edges (depending upon the direction of motion) which are at least in part of concave configuration.

Advantageously, the concave portions of the side edges are chamfered.

Preferably, the flexible sheet forming the blade is of generally rectangular configuration and is adapted to be supported above the ink tray at one of its side edges, the edge opposite to said one side edge also being at least in part of concave configuration, whereby the concave portions of the two side edges and the bottom edge define therebetween respective tongue portions at the lowermost corners of the blade.

In accordance with a second aspect of the invention, there is provided an ink agitating apparatus for agitating ink in an ink tray disposed adjacent to an inking roller in a printing machine, comprising a blade in the form of a flexible, generally rectangular, longitudinally curved sheet of plastic or metal which is suspended from one end into an ink tray and is reciprocable laterally within the ink tray, the two bottom corners of the blade being arranged to extend into an ink exit region of the ink tray, defined between the tray and the inking roller, and the edges of the blade being configured such that the hydrodynamic forces to which it is subjected when it is reciprocated along the ink tray cause it to twist longitudinally whereby, in each traverse of the blade the bottom corner which is leading moves toward the inking roller and the bottom corner which is trailing and moves away from the inking roller.

By way of example only, a specific embodiment of the present invention will now be described with reference to the accompanying drawings, in which:

FIG. 1 is a partial transverse section through a conventional inking apparatus showing the position of the inking tray and ink pool relative to the inking roller;

FIG. 2 is a plan view of an ink agitating blade for an ink agitating apparatus;

Figure 3:
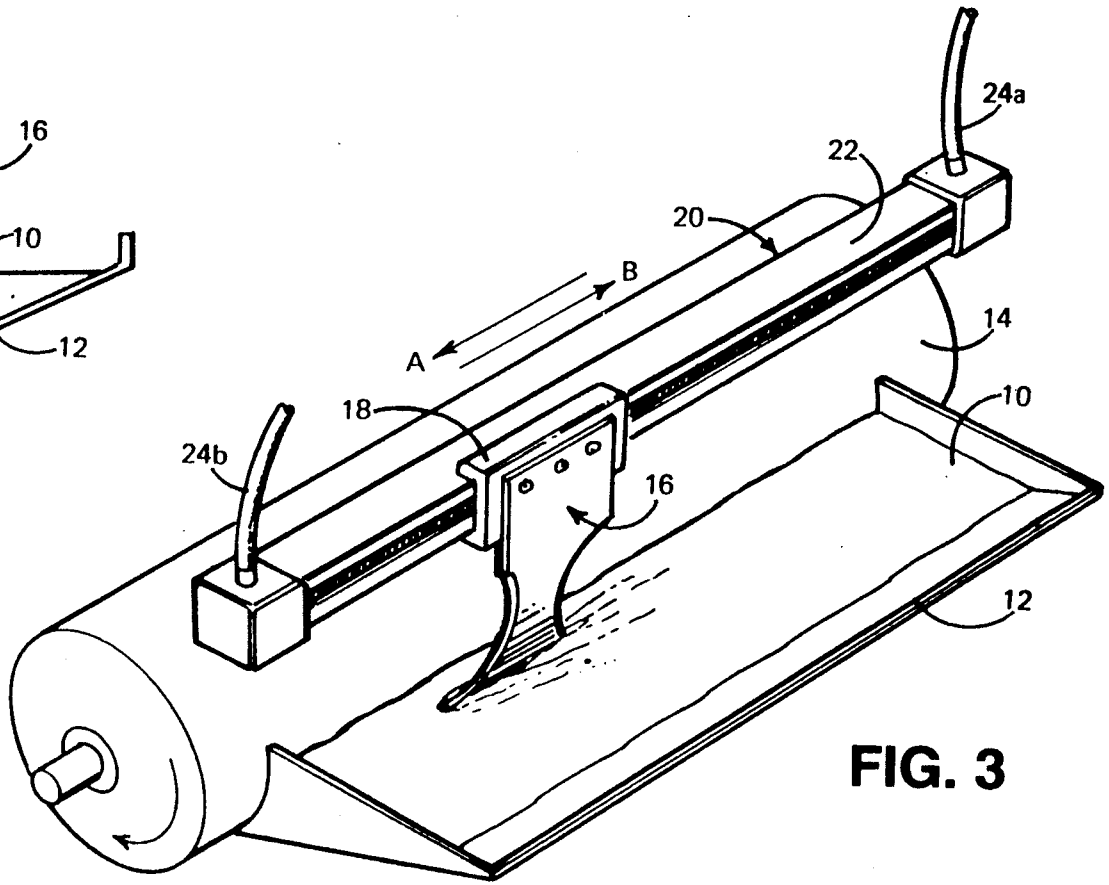
FIG. 3 is a perspective view of an ink agitating apparatus incorporating the ink agitating blade of FIG. 2.

Ink from an ink pool or reservoir 10 contained in a conventional ink tray 12, for application onto a rotating inking roller 14, is stirred by means of an ink agitating blade 16 which is arranged to be reciprocated laterally in the ink pool 10, along the length of the ink tray 12. Reciprocating fingers are also contained within the tray 12 in a conventional manner but are not illustrated as they form no part of the present invention.

The blade 16 is attached to a carrier member 18 which is adapted to be displaced back and forth, as indicated in FIG. 3 by arrows A and B above the ink tray 12 by a known drive mechanism 20. The mechanism 20 comprises a sealed piston (not visible in the drawings) which is displaceable in a reciprocating manner within a tubular housing 22 by the application of compressed air (or hydraulic fluid) alternately to fluid inlet/outlets 24*a*, 24*b* at the opposite ends of the housing 22. By this mechanism 20, the carrier member 18, and hence the blade 16, can be reciprocated along the whole length of the tray 12 at a controlled speed and repetition frequency.

The apparatus described thus far is conventional in principle.

Figure 4:
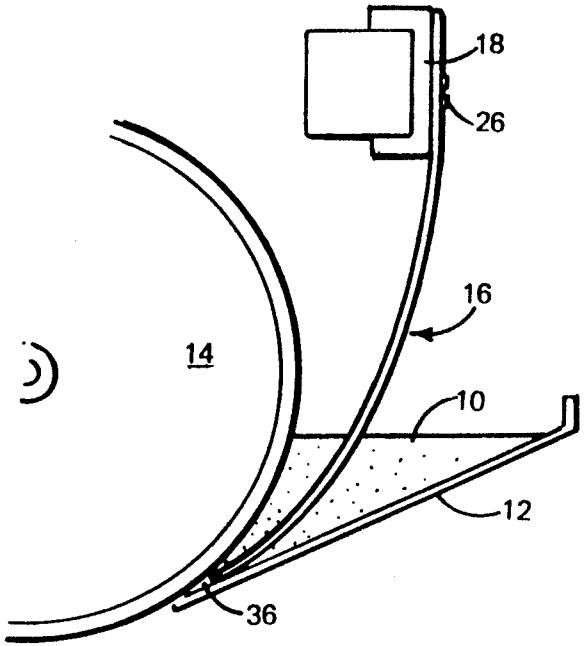
FIG. 4 is a partial transverse section of the apparatus of FIG. 3, corresponding to the view of FIG. 1.

The blade 16 of the present apparatus is illustrated in plan view in FIG. 2. As viewed in this figure, the upper part of the blade (shown broken) is connected rigidly to the carrier member 18 by means of screws or bolts 26. The blade 16 is basically rectangular in plan but has concave recesses 28*a*, 28*b* in its lateral side edges 29*a*, 29*b*, which will form leading and/or trailing edges of the blade, depending upon whether it is moving right to left (arrow A) or left to right (arrow B) in the view of FIG. 3. The blade 16 also has a concave recess 30 in its bottom edge 31. By virtue of the presence of the recesses 28*a*, and 28*b* and 30, there are formed at the bottom corners of the blade respective tongue portions 32*a*, 32*b*, having substantially pointed tips 34*a*, 34*b*, the extreme ends of which can be rounded off. The edges of the blade defining the concave recesses 28*a*, 28*b* can be chamfered so as to reduce frictional resistance through the ink. As best seen in FIG. 4, the blade 16 is inherently curved along its length so that, with the blade stationary, the tips 34*a*, 34*b* of said tongue portions 32*a*, 32*b* both lie at the foot of the ink pool, in the region of the "nip" between the inking roller 14 and the lowermost edge of the ink tray 12. In use, the blade 16 extends into the pool to a depth such that the surface level of the ink in the tray 12 lies within the recessed portion of the edges 29, for example, as indicated by surface level X in FIG. 2.

Advantageous operational effects are obtained, as follows, by virtue of this blade construction.

In the case, for example, where the blade 16 is being moved by the hydraulic drive 20 in the direction "A", edge 29*a* is the leading edge of the blade and edge 29*b* is the trailing edge. During this movement, the chamfered concave recess 28*a* moves through the surface of the ink and reduces the likelihood of the formation of a bow wave, which would otherwise form, as the blade moves across the pool 10. The presence of such a bow wave in known apparatuses can cause ink splashing and ink spillage out of the tray 12. Furthermore, the presence of the concave recess 28*a* prevents ink from between squeezed up the leading edge 29*a* when the latter comes up against or adjacent the side of the ink tray at the extreme end of its movement. When a straight-sided blade is used, ink can be projected forcibly upward and out of the tray by such a squeezing action.

When the blade 16 reaches the left-hand side of the tray as viewed in FIG. 3, it reverses down the tray 12 in the opposite direction "B". The edge 29*b* then becomes the leading edge, and edge 29*a* the trailing edge.

The provision of the concavely configured recess 30 in the bottom edge 31 of the blade has the effect that, when the blade 16 is moved laterally across the ink pool 10, it is able to flex and distort under the hydrodynamic forces to which it is subjected, whereby the leading tip portion 32*a* (when moving in the direction A) moves toward the inking roller 14 in the ink exit region 36 (FIG. 4), formed between the inking roller 14 and the foot of the ink tray 12, whereas the trailing tip portion 32*b* moves away from the inking roller. When travelling in the opposite direction B, the blade distorts in the opposite sense and the situation reverses so that the tip portion 32*b* (then the leading tip) lies closer to the inking roller than the (trailing) tip portion 32*a*. This has the effect of enhancing the ability of the apparatus to remove suspended lint in the ink from the locality of the nip region 36.

It is preferred that there be included in the apparatus a means for automatically halting the movement of the blade (preferably at one side of the tank) when the ink level in the tray is to be measured and topped up. This enables measurements to be made when the ink surface level is flat and calm.

We claim:

1. An ink agitating apparatus for agitating ink in an ink tray disposed adjacent to an inking roller in a printing machine, the ink agitating apparatus comprising a blade which is adapted to be suspended into the ink in the ink tray and to be reciprocated laterally therewithin, wherein:

(a) the blade comprises a flexible, longitudinally curved sheet of generally rectangular configuration having leading and trailing side edges, depending upon the direction of motion, which are at least in part of concave configuration;

(b) the flexible sheet forming the blade has a top edge by which the blade is supported above the ink tray and a bottom edge which lies opposite to said top edge and is also at lest in part of concave configuration, whereby the concave portions of said two side edges and said bottom edge of said sheet define therebetween respective tongue portions at the lowermost corners of the blade;

(c) said two lowermost corners of the blade defined by said tongue portions extend into an ink exit region of the ink tray, defined between the tray and the inking roller; and (d) said side edges and said bottom edge of the blade are configured such that the hydrodynamic forces to which the blade is subjected when the blade is reciprocated along the ink tray cause the blade to twist longitudinally whereby, in each reciprocation of the blade, the lowermost corner which is leading moves toward the inking roller and the lowermost corner which is trailing moves away from the inking roller.

2. An ink agitating apparatus according to claim 1, wherein the concave portions of said side edges are chamfered.

3. An ink agitating apparatus for agitating ink in a printing machine, comprising an inking roller, an ink tray disposed adjacent to said inking roller, a blade in the form of a flexible, generally rectangular, longitudinally curved sheet, means suspending said blade into the ink tray, means for reciprocating said suspended blade laterally within said ink tray, the blade having a bottom edge and two bottom edge corners which are arranged to extend into an ink exit region of the ink tray which is defined between the tray and the inking roller, said bottom edge of the blade being configured such that the hydrodynamic forces to which the blade is subjected when it is reciprocated along the ink tray cause the blade to twist longitudinally whereby, in each traverse of the blade, the leading bottom corner moves toward the inking roller and the tailing bottom corner moves away from the inking roller.

4. An ink agitating apparatus according to claim 3, wherein the blade has side edges and each side edge has a concave recess.

5. An ink agitating apparatus according to claim 4, including a further concave recess in the bottom edge of the blade.

6. An inking agitation apparatus for agitating ink in an ink tray disposed adjacent to an inking roller in a printing machine, the ink agitating apparatus comprising a blade which is suspendable into the ink in the ink tray and reciprocatable laterally in the ink tray, wherein said blade comprises a longitudinally curved sheet of generally rectangular configuration having a top edge, a bottom edge, said edges and two bottom corners, said side edges being at least in part of concave configuration, said blade being sufficiently flexible so that it is capable of twisting as it is reciprocating laterally whereby, as the blade is reciprocated laterally, one of said bottom corners, which is leading, moves toward the inking roller and one of said bottom corners, which is trailing, moves away from the inking roller due to the hydrodynamic forces to which the blade is subjected when the blade is reciprocated in the ink tray.

* * * * *

UNITED STATES PATENT AND TRADEMARK OFFICE

CERTIFICATE OF CORRECTION

PATENT NO. : 5,267,793

DATED : December 7, 1993

INVENTOR(S) : Peter R. Hawitt

It is certified that error appears in the above-indentified patent and that said Letters Patent is hereby corrected as shown below:

Column 1, line 7, before "paper" insert -- the --.

Column 1, lines 19,20, change "inkthickness" to -- ink thickness --.

Column 4, line 43, change "agitation" to -- agitating --.

Signed and Sealed this

Twenty-fifth Day of April, 1995

*Attest:*

*Attesting Officer*

BRUCE LEHMAN

*Commissioner of Patents and Trademarks*